US005474240A

United States Patent [19]

Satomi

[11] Patent Number: 5,474,240

[45] Date of Patent: Dec. 12, 1995

[54] PAPER MATERIAL REFINING APPARATUS

[75] Inventor: Hitoshi Satomi, Shizuoka, Japan

[73] Assignee: Satomi Seisakusho Co., Ltd., Shizuoka, Japan

[21] Appl. No.: 415,989

[22] Filed: Apr. 4, 1995

[30] Foreign Application Priority Data

Jan. 20, 1995 [JP] Japan ..... 7-006841

[51] Int. Cl.[6] ..... B02C 19/22

[52] U.S. Cl. ..... 241/74; 241/77; 241/260.1

[58] Field of Search ..... 241/69, 74, 77, 241/79, 81, 247, 261.1, 260.1

[56] References Cited

U.S. PATENT DOCUMENTS

| | | | |
|---|---|---|---|
| 1,454,492 | 5/1923 | Stroud | 241/79 X |
| 1,846,061 | 2/1932 | Marshall | 241/261.1 |
| 2,557,865 | 6/1951 | Emmanouilidis | 241/74 |
| 4,986,480 | 1/1991 | Gullichsen et al. | 241/28 |
| 5,025,993 | 6/1991 | Satake | 241/74 |
| 5,156,872 | 10/1992 | Lee | 241/260.1 X |
| 5,383,608 | 1/1995 | Dahlqvist et al. | 241/16 |

*Primary Examiner*—Timothy V. Eley
*Assistant Examiner*—John M. Husar
*Attorney, Agent, or Firm*—Kanesaka & Takeuchi

[57] ABSTRACT

An apparatus for refining a paper material is formed of a casing, a first chamber situated in the casing and having first and second openings, a second chamber situated inside the casing adjacent the first chamber and having a third opening, a screen plate for dividing the casing into the first and second chambers, and an agitating member situated inside the first chamber adjacent to the screen plate for agitating the paper material in the first chamber. The screen plate removes a part of foreign substances in the paper material. In the invention, a cleaning device for removing the other part of the foreign substances contained in the paper material is situated in the first chamber or the second chamber. The cleaning device is formed of a plurality of cleaners. The paper material supplied from the first opening passes through the cleaning device and the screen plate, and is discharged from the third opening so that the one and the other foreign substances are substantially removed from the paper material.

11 Claims, 6 Drawing Sheets

PAPER MATERIAL REFINING APPARATUS

BACKGROUND OF THE INVENTION AND RELATED ART STATEMENT

The present invention relates to an apparatus for refining paper materials, and more particularly, to a paper material refining apparatus including a built-in cleaner which separates foreign materials or substances by specific gravity to remove the same, which are hardly removed by a screen plate.

As an apparatus for removing dust and foreign substances from paper materials through a screen plate, a screen type paper material refining apparatus has been known. Also, as an apparatus for removing foreign substances from the paper materials by the difference of specific gravity while utilizing centrifugal force and liquid shear force, there is a cleaner or swirl type dust removing apparatus. In the cleaner, the foreign substances which can not be removed by the refining apparatus with the screen plate can be removed by difference of specific gravity. Therefore, after or before processing the paper material by the refining apparatus with the screen, the cleaner is connected thereto through a pipe, so that the dust and foreign substances are removed completely from the paper materials. However, when the cleaner is connected to the refining apparatus with the screen by the pipe, it requires a larger installation site, and pipe connection between the refining apparatus with the screen to the cleaner at the installation site to cause cumbersome.

Accordingly, an object of the present invention is to provide a paper material refining apparatus including a screen plate and a built-in cleaner so as to obviate the foregoing problems.

Further objects and advantages of the invention will be apparent from the following description of the invention.

SUMMARY OF THE INVENTION

In achieving the foregoing and other objects of the present invention, there is provided an apparatus for refining paper materials, which includes a casing, a screen plate, an agitating member, cleaning means, and first and second passageways therein. The casing has a casing inlet for supplying a paper material, first and second casing discharge ports for discharging foreign substances, and a casing outlet for a refined paper material. The screen plate divides an interior of the casing into first and second chambers. The agitating member is located adjacent to the screen plate for agitating the paper material. The cleaning means is formed of a plurality of cleaners, and each cleaner has a cleaner inlet for a paper material, a cleaner outlet for a refined paper material, and a cleaner discharge port for foreign substances.

In this embodiment, the cleaning means is disposed in the first chamber so as to remove foreign substances which are difficult for the screen plate to remove. The first and second passageways are disposed at an upstream side of the agitating member in the first chamber. The first passageway connects the cleaner inlets and the casing inlet. On the other hand, the second passageway connects the cleaner discharge ports for foreign substances with the casing discharge port for the foreign substances. The cleaner inlets for a paper material are located at an upstream side of the agitating member outside the first and second passageways in the first chamber. The second casing discharge ports for foreign substances is located away from the cleaner outlets for a refined paper material and is disposed outside the first and second passageways in the first chamber.

According to the present invention, the casing is divided into a lid and a main part, and the lid is freely attached to and separated from the main part of the casing. The lid holds a plurality of cleaners and the first and second passageways therein. A plurality of cleaners is disposed in parallel, so that the cleaner discharge ports for the foreign substances are located near a side of the lid and the cleaner outlets for a refined paper are located away from the reverse side of the lid.

Further, according to the present invention, an apparatus for refining a paper material may be formed of a casing, a partition wall, a screen plate, an agitating member, cleaning means, and first, second and third passageways. The casing has a casing inlet for supplying a paper material, first and second casing discharge ports for discharging foreign substances, and a casing outlet for a refined paper material. The partition wall divides an interior of the casing into first and second chambers, and the screen plate allows communication between the first and second chambers. The agitating member is located adjacent to the screen plate for agitating the paper material. The cleaning means is formed of a plurality of cleaners, and each cleaner has a cleaner inlet for a paper material, a cleaner outlet for a refined paper material, and a cleaner discharge port for foreign substances.

In this embodiment, the cleaning means is disposed in the second chamber for removing foreign substances which are difficult for the screen plate to remove. The first passageway is located to receive the paper material passing through the screen plate. The second passageway is disposed to communicate the cleaner discharge ports for the foreign substances with the casing discharge port for the foreign substances. The third passageway is disposed as to communicate the cleaner outlets for a paper material with the casing outlet for a refined paper. The casing inlet for a paper material and the first casing discharge port for foreign substances are disposed in the first chamber. The second casing discharge port for foreign substances and the casing outlet for the refined paper material are disposed in the second chamber.

According to a first aspect of the present invention, the cleaning means is located in the upstream side of the screen plate, so that the paper materials flow to the screen plate after the cleaning means removes the foreign substances. Also, since the paper material refining apparatus includes the built-in cleaning means, in case an apparatus with cleaning means is required before or after the apparatus with the screen plate, it is not necessary to connect the apparatus with the screen plate with the apparatus with the cleaning means by a pipe at an installation site.

According to a second aspect of the present invention, in addition to the first aspect thereof, a plurality of the cleaners is disposed in parallel as the cleaning means, and the cleaner discharge ports for the foreign substances are located near the reverse side of the lid, and cleaner outlets for the refined paper are located away from the lid. Therefore, the paper material refining apparatus can include the clean means having compact structures therein. Further, the diameter of the cleaner can be made small and disposed in parallel.

According to a third aspect of the present invention, in addition to the second aspect thereof, when the lid is separated from a main part of the casing, the cleaner outlets for the refined paper material are exposed to the outside.

According to a forth aspect of the present invention, in addition to the first aspect thereof, the cleaning means is disposed at the downstream side of the screen plate for removing the foreign substances, so that the paper material flows to the cleaning means after the screen plate removes the foreign substances.

DETAILED DESCRIPTION OF PREFERRED EMBODIMENTS

An embodiment of the present invention will be described with reference to the accompanying drawings. As shown in FIG. 1 through FIG. 5, a paper material refining apparatus 1 includes built-in cleaners 2, i.e. swirl type dust remover, which remove foreign substances from a paper material by utilizing centrifugal force and liquid sheer force. The cleaners 2 utilize specific gravity to remove foreign substances which can not be removed by a screen plate 3.

Figure 1:
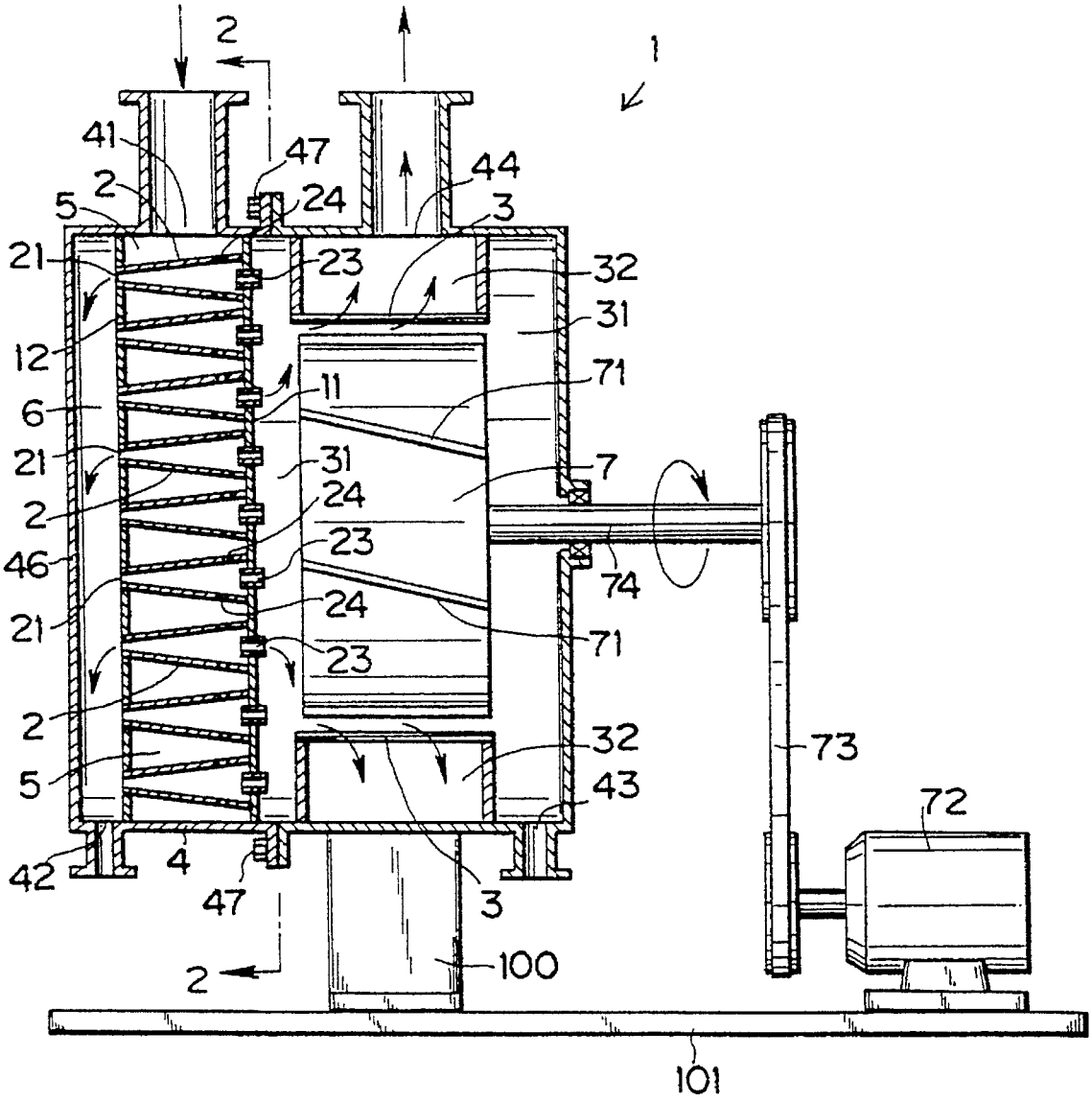
FIG. 1 is a partial cross sectional view for schematically illustrating one embodiment of the paper material refining apparatus of the present invention.
Figure 2:
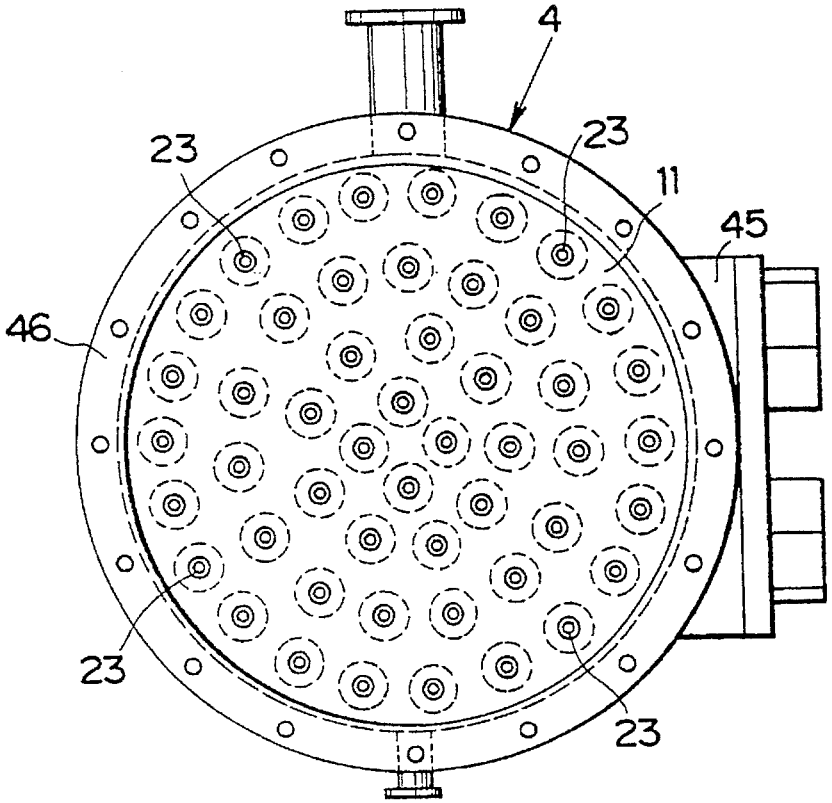
FIG. 2 is a schematic sectional view taken along a line 2—2 in FIG. 1.
Figure 3:
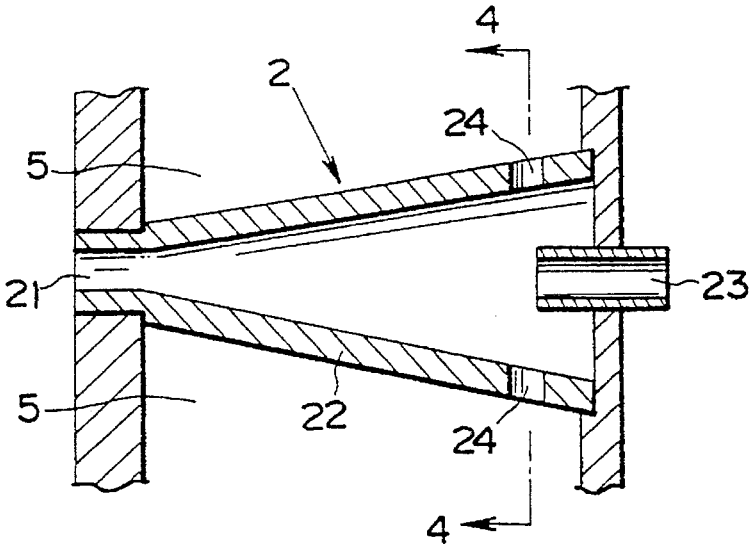
FIG. 3 is a schematic side sectional view of one of the cleaners shown in FIG. 1.
Figure 4:
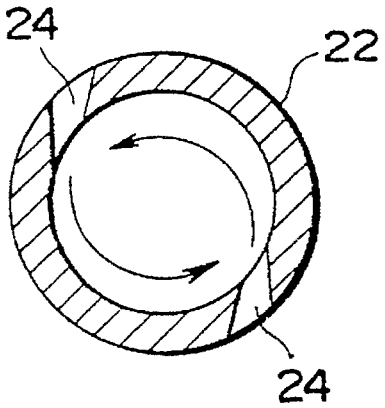
FIG. 4 is a schematic sectional view taken along a line 4—4 in FIG. 3.
Figure 5:
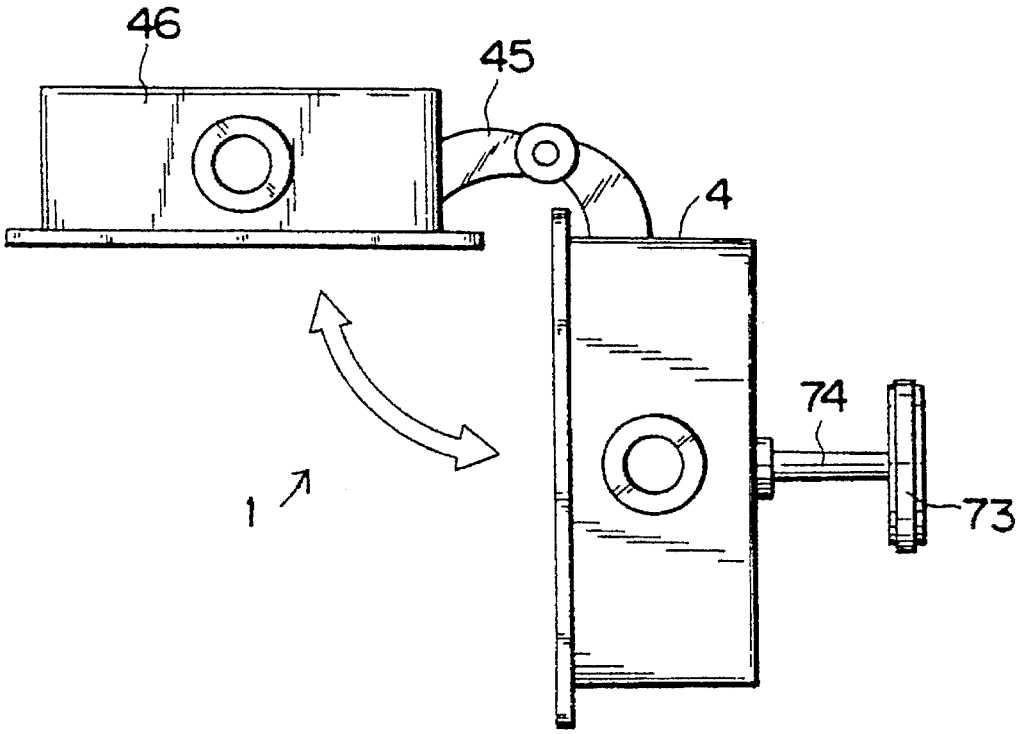
FIG. 5 is a schematic plan view showing a state in which a lid of the paper material refining apparatus of FIG. 1 is opened.

A casing 4 includes a casing inlet 41 for supplying a paper material, first and second casing discharge ports 42, 43 for discharging foreign substances, and a casing outlet 44 for discharging a refined paper material. As shown in FIGS. 1 and 5, for example, the casing 4 is divided into two parts, and one part of the casing 4 is formed of a lid 46 connected to the other part of the casing 4 by a hinge 45 so that the lid 46 is freely attached to and separated from the other part of the casing 4. The lid 46 is fixed to the other part of the casing 4 by bolts 47.

In the lid 46, a plurality of cleaners 2 and first and second passageways 5, 6, explained later, are disposed. The casing 4 is fixed to a supporting table 101 by a supporting member 100.

Interior of the casing 4 is divided into a first chamber 31 and a second chamber 32 by means of a screen plate 3 having round openings or slits, e.g. cylindrical screen plate 3. The casing inlet 41 and the first and second casing discharge ports 42, 43 are disposed in the first chamber 31, and the casing outlet 44 is disposed in the second chamber 32.

An agitating member 7 is disposed adjacent to the screen plate 3 in the first chamber 31. The agitating member 7 rotates so as to stir a paper material supplied into the casing 4. The agitating member 7 is formed, for example in a cylindrical shape, and has a plurality of projections 71 at an periphery thereof. A motor 72 is used as a driving source, and rotation of the motor 72 is transferred to a rotary shaft 74 through a belt 73.

Incidentally, the agitating member 7 and the screen plate need not be limited to the structure as shown in FIG. 1. For example, it may be a combination of an impeller 10 and a screen plate 7 as disclosed in Japanese Patent Publication (KOKAI) No. 61-293512.

In an upstream side of the agitating member 7 in the first chamber 31, a plurality of cleaners is disposed for removing foreign substances which are difficult for the screen plate 3 to remove. For the purpose of removing heavy foreign substances, e.g., sand, each cleaner 2 is formed of a conical casing 22 having a cleaner discharge port 21 for foreign substances at a top end of the casing 22. In the center of an end wall opposite to the discharge port 21, a cleaner outlet 23 for a refined paper is formed, and on the side of the casing 22 away from the discharge port 21, a plurality of cleaner inlets 24 for a paper material is disposed.

Also, the cleaner inlets 24 communicate with the casing inlet 41 for supplying paper material through the first passageway 5, and the cleaner discharge ports 21 communicate with the first casing outlet 42 for discharging foreign substances through the second passageway 6. The first and second passageways 5, 6 are disposed at the upstream side of the agitating member 7 in the first chamber 31.

The cleaner outlets 23 for the refined paper are disposed at the upstream side of the agitating member 7 outside the first and second passageways 5, 6 in the first chamber. The second casing outlet 43 for discharging the foreign substances is located away from the cleaner outlets 23 for the refined paper, and is disposed outside the first and second passageways 5, 6 in the first chamber 31.

A plurality of the cleaners 2 is disposed in parallel so that the cleaner discharge ports 21 are located near a reverse side or inside of the lid 46 and the cleaner outlets 23 for the refined paper are located away from the reverse side of the lid 46. A plurality of cleaners 2 is attached to first and second partition members 11, 12 which are fixed the lid 46. The first passageway 5 faces the cleaner inlets 24 for the paper material, and the cleaner outlets 24 for the refined paper face outside the first and second passageways 5, 6 in the first chamber 31 at the upstream side of the agitating member 7.

In use, when the paper material, such as pulp, used papers and the like, is supplied by a pressure pump (not shown) from the casing inlet 41 for the paper material, the paper material flows into the casings 22 of the cleaners 2 through the cleaner inlets 24. Then, the paper material introduced into the casings 22 of the cleaners 2 turns to cause a swirl. Accordingly, heavy foreign substances, such as sands, are located outside of the swirl and a refined paper material containing fibers is located at the center side of the swirl.

As a result, the paper material containing mostly fibers flows to the agitating member 7 through the cleaner outlets 23. On the other hand, the heavy foreign substances, such as sands, are discharged from the cleaner discharge ports 21, so that the foreign substances flow into the second passageway and are discharged outside the casing 4 through the first casing outlets 42 for the foreign substances.

The paper material directed to the agitating member 7 through the outlets 23 is stirred by the agitating member 7, so that the paper material is dissociated. Thereafter, the paper material passes through the screen plate so as to remove the foreign substances and dusts from the paper material. A refined paper material is discharged outside the casing 4 through the second chamber 32 and the casing outlet 44 for the refined paper material. The foreign substances which can not pass through the screen plate 3 are discharged outside the casing 4 through the second casing outlet 43 for the foreign substances.

In the embodiment of the paper material refining apparatus 1, since the cleaners 2 are included in the casing, in case the cleaners are required before or after the apparatus with the screen plate, it is not necessary to connect the apparatus with the screen plate with the cleaners by a pipe at a working site, so that workability can be improved. Furthermore, inside the casing 4, there is a structure corresponding to a piping. Namely, the first passageway 5, the second passageway 6 and the cleaner outlets 23 for the refined paper material are located at the upstream side of the agitating member 7, and the cleaner outlets 23 face the first chamber outside the first and second passageway 5, 6. Thus, an installation space is not required so much.

Further, a plurality of cleaners 2 is disposed in parallel such that a plurality of cleaner discharge ports 21 for the foreign substances is located near the reverse or inner side of the lid 46, and a plurality of cleaner outlets 23 for the refined paper is located away from the lid 46. Also, a plurality of cleaners 2 is fixed, for example, to the first and second partition members 11, 12 which are disposed inside the lid 46. Thus, the cleaners 2 can be made compact and can be situated inside the paper material refining apparatus 1.

Further, the casing 4 is divided into two parts, and one part is formed of the lid 46 which is freely attached to and separated from the other part. Inside the lid 46, a plurality of cleaners 2 and the first and second passageways 5, 6, are disposed. Also, the cleaners are disposed in parallel so that a plurality of cleaner discharge ports 21 for the foreign substances is located near the lid 46, and a plurality of cleaner outlets 23 for the refined paper material is located away from the inner side of the lid 46. Therefore, when the lid 46 is separated from the other part of the casing 4, the cleaner outlets 23 for the refined paper material are exposed to the outside, so that the problem caused in the cleaner outlets 23, e.g. choking or clogging, can be checked and solved easily.

Also in this embodiment, each cleaner 2 includes the cleaner discharge port 21 for foreign substances at the top end of the conical casing 22 for removing heavy substances, e.g. sand.

Figure 6:
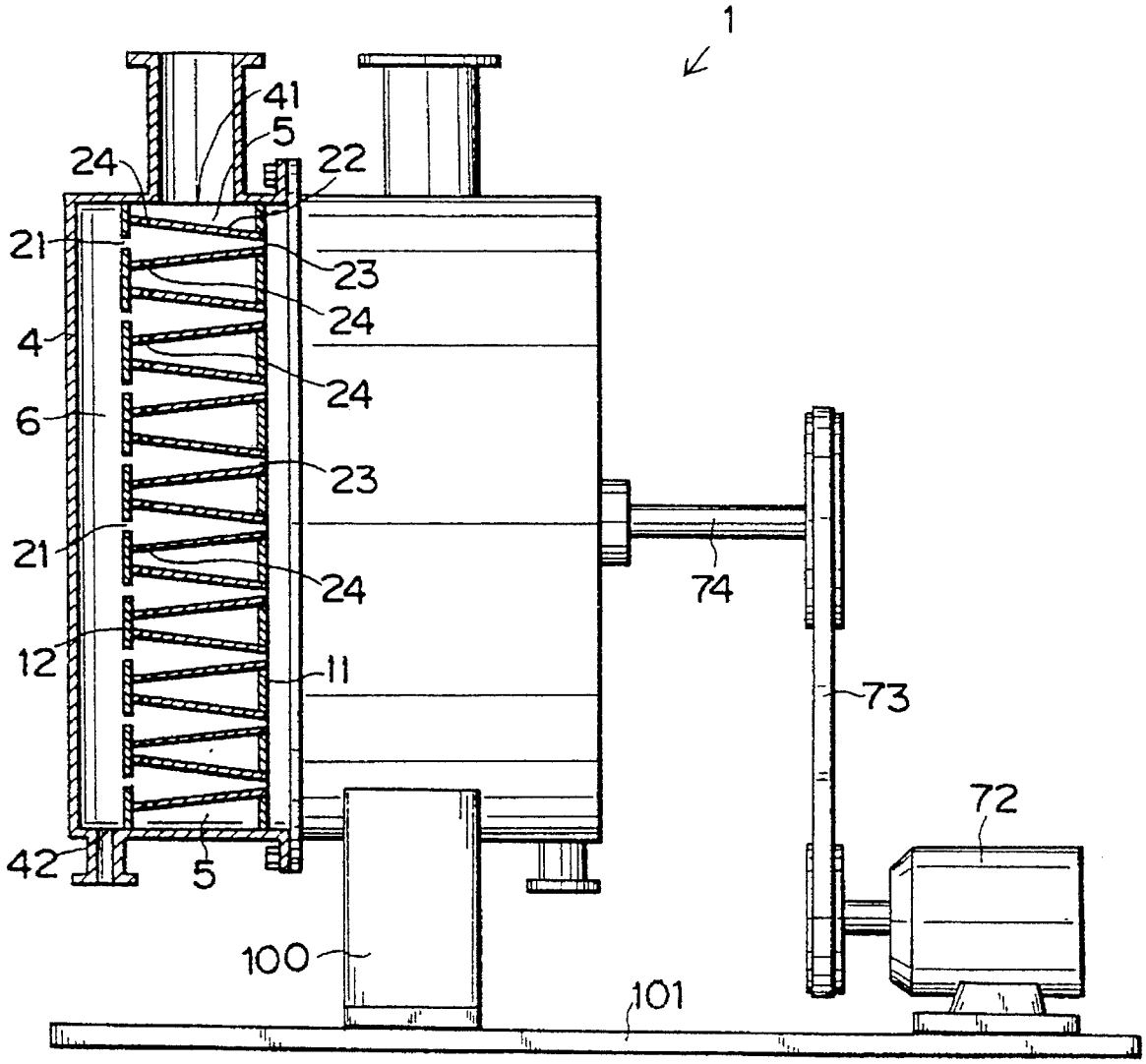
FIG. 6 is a partial cross sectional view for schematically illustrating an alternative embodiment to FIG. 1.

Alternatively, as shown in FIG. 6, the direction of the conical casing 22 may be disposed opposite to the direction of the casing 22 shown in FIG. 1, depending on the kind of foreign substances included in a paper material, so that the cleaners can remove light foreign substances, e.g., films. In other words, the top end of the conical casing 22 is used for the outlet of the foreign substances, and the outlet 23 is used for the refined paper material. A plurality of the cleaner inlets 24 for the paper material is disposed on the side of each casing 22.

Therefore, when a paper material is supplied into the casing 22 through the cleaner inlets 24, the paper material turns to form a swirl, so that light foreign substances, such as films, are located near the center of the casing 22 and the paper material containing a lot of fiber are located at the cleaner outlet 23 for the refined paper material, which is disposed at the top end of the casing 22.

Thereafter, the paper material containing a lot of fibers flows to the agitating member 7 through the cleaner outlets 23, and the light foreign substances, such as films, are discharged outside the casing 4 through the cleaner discharge ports 21 and the second passageway 6. After the paper material refined by the cleaners 2 flows to the agitating member 7, the paper material is further refined in the same way as explained in first-mentioned embodiment. Therefore, this part of description is omitted.

Figure 7:
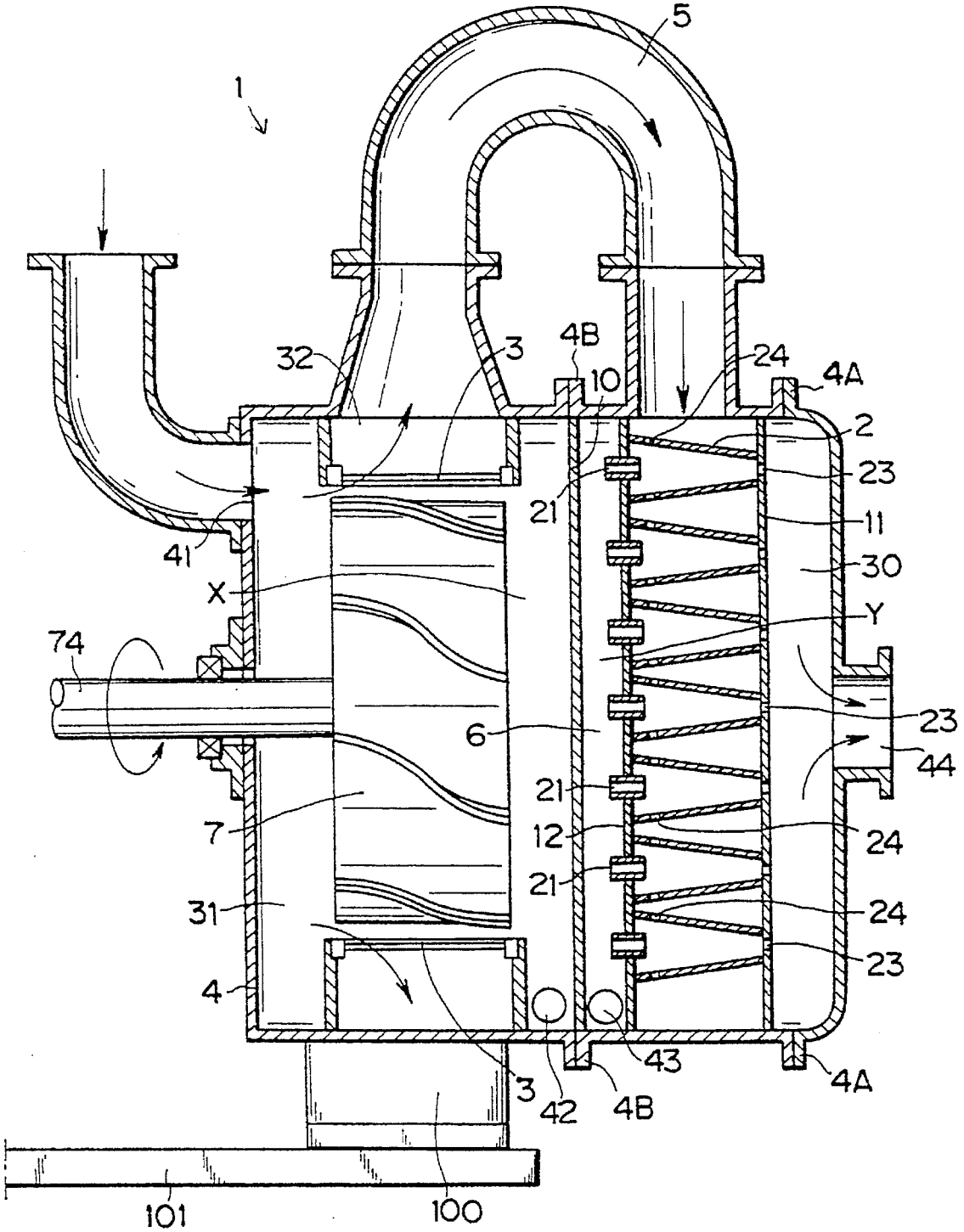
FIG. 7 is a partial cross sectional view schematically illustrating an alternative embodiment to FIG. 6.

In the first embodiment of the paper material refining apparatus 1 explained above, the cleaners 2 are located at an upstream side of the screen plate 3. Therefore, the cleaners 2 remove the foreign substances first so as to prevent the screen plate 3 from being damaged by the foreign substances. However, the invention need not be limited to this structure. For example, as shown in FIG. 7, cleaners 2 may be disposed at a downstream side of a screen plate 3. As a result, the screen plate 3 removes foreign substances so as to prevent the cleaners 2 from being clogged by the foreign substances.

In this embodiment, as shown in FIG. 7, a casing 4 is divided into a first section X and a second section Y by a partition wall 10, and the first section X is divided into first and second chambers 31, 32 by a screen plate 3. Further, a casing inlet 41 for supplying a paper material into the casing 4 and a fist casing discharge port 42 for discharging foreign substances outside the casing 4 are disposed in the first chamber 31, and a second casing discharge port 43 for discharging foreign substances outside the casing 4 and a casing outlet 44 for discharging a refined paper material outside the casing 4 are disposed in the second section Y. Also, a plurality of cleaners 2 is disposed at a downstream side of an agitating member 7 in the second section Y so as to remove foreign substances which are difficult for the screen plate 3 to remove.

Each cleaner 2 has a cleaner inlet 24 for a paper material, a cleaner discharge port 21 for foreign substances, and a cleaner outlet 23 for a refined paper material. The cleaner inlets 24 for a paper material communicate with the second chamber 32 through a first passageway 5, and the cleaner discharge ports 21 for foreign substances communicate with the second casing outlet 43 for the foreign substances through a second passageway 6. Namely, the second passageway 6 is formed in the second section Y. Further, the cleaner outlets 23 for the paper material communicate the casing outlet 44 for the refined paper through a third passageway 30.

The first passageway 5 is formed at the downstream side of the agitating member 7 in the second section Y. The agitating member 7 is disposed adjacent to the screen plate 3, e.g. in the first chamber 31, so as to agitate the paper material in the first chamber 31.

Also, one end of the first passageway 5 communicates with the cleaner inlets 24 for the paper material, and one side of the second passageway 6 communicates with a plurality of cleaner outlets 21 for the foreign substances. Further, one side of the third passageway 30 communicates with a plurality of cleaner outlets 23 for the refined paper material.

Therefore, in the embodiment as shown in FIG. 7, likewise the first embodiment, when a paper material, i.e., a pulp, used papers and the like, is supplied into the casing 4 by a pressure pump (not shown) through the casing inlet 41 for a paper material, the paper material flows to the agitating member 7.

The paper material led to the agitating member 7 is agitated and separated, and the screen plate 3 removes a dust and foreign substances from the paper material. The partially refined paper material flows into the cleaner inlets 24 through the first passageway 5. The foreign substances which can not pass the screen plate 3 are discharged outside the casing 4 through the first casing discharge ports 42.

After flowing into the casing 22 of the cleaner 2, the paper material turns and forms a swirl so that light foreign substances, such as films, are located in the center of the casing and a paper material containing a lot of fibers is located near the top end of the cleaner 2.

As a result, the paper material containing a lot of fibers is discharged outside the casing 4 from the cleaner outlet 23 through the third passageway 30 and the casing outlet 44. The light foreign substances, such as films, are discharged outside the casing 4 through the cleaner discharge ports 21, the second passageway 6 and the second casing outlet 43.

In this embodiment of the paper material refining apparatus 1, since the apparatus includes the built-in cleaners 2, in case the cleaners are required before or after the paper refining apparatus with the screen plate, it is not necessary to connect the cleaners to the apparatus by a pipe at a working site, so that workability can be improved. Furthermore, a large space is not required for the apparatus. Also, the cleaners 2 are disposed at the downstream side of the screen plate 3 which removes large foreign substances, so that this structure can prevent the cleaners from being clogged with the large foreign substances. The diameter of each cleaner is made relatively small, and the cleaners are disposed in parallel. Accordingly, even if the fluid pressure supplied into the cleaners 2 is low, the cleaners can remove the foreign substances from the paper material. Further, since the cleaner is made small and a plurality of cleaners is disposed, the apparatus in whole is compact and improved in its workability.

Further, the cleaners 2 are fixed to the first and second partition members 11, 12, and as shown in FIG. 7, the second section Y is divided by flanges 4A, 4B of the casing 4. Therefore, when the casing 4 is opened at the flanges 4A, 4B, the cleaner outlets 23 and the cleaner discharge ports 21, which tend to be clogged, are exposed outside, so that the cleaners 2 can be checked easily.

Figure 8:
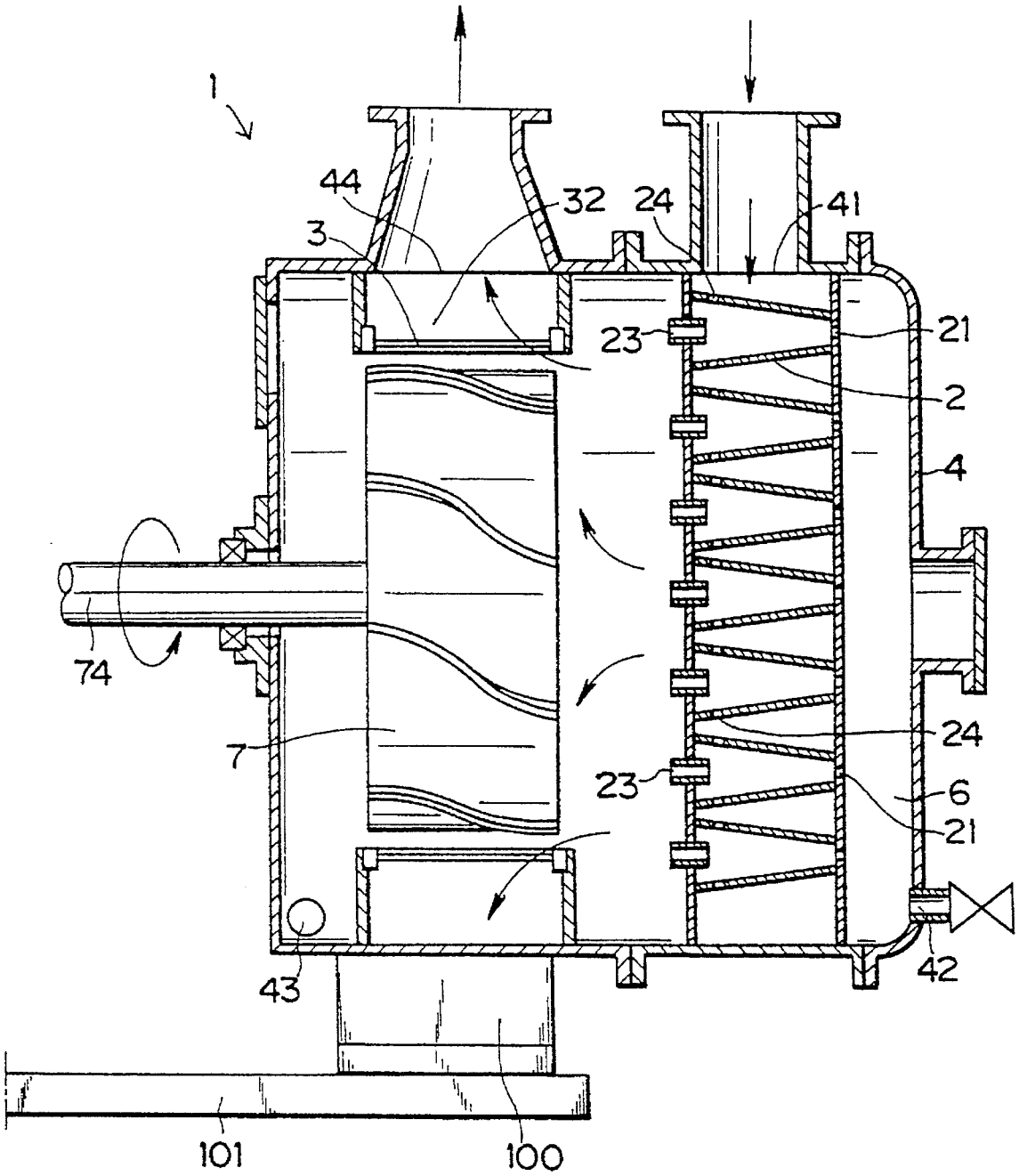
FIG. 8 is a partial cross sectional view for schematically illustrating an alternative embodiment to FIG. 7.

Alternatively, in the embodiment of the paper material refining apparatus 1 as shown in FIG. 7, the casing inlet 41 for a paper material, the casing outlet 44 for a refined paper material, and the first and second casing discharge ports 42, 43 for foreign substances may be closed, and the first passageway 5 and the partition wall 10 may be removed. Consequently, as shown in FIG. 8, the paper material refining apparatus may be formed such that the cleaners 2 are located at an upstream side of a screen plate 3.

Namely, when a paper material, such as pulp and used papers, is supplied by a pressure pump (not shown) from the casing inlet 41, the paper material flows into cleaner inlets 24. The paper material flowed into casings 22 of the cleaners 2 turns and forms a swirl, so that heavy foreign substances, such as sands, are located outside of the swirl and paper materials containing fibers are located in the center of the swirl.

As a result, the paper material containing mostly fibers flows to the side of the agitating member 7 through the cleaner outlets 24. On the other hand, the heavy foreign substances, such as sands, are discharged outside the casing 4 through the cleaner discharge ports 21, the second passageway 6 and the first casing discharge port 42.

The paper material flowed to the agitating member 7 is stirred by the agitating member 7, so that the paper material are separated. Thereafter, the paper material passes through the screen plate 3 so as to remove the foreign substances and dusts from the paper material. The refined paper material is discharged outside the casing 4 through the second chamber 32 and the casing outlet 44. The foreign substances which can not pass through the screen plate 3 are discharged outside the casing 4 through the second casing outlet 43.

According to the first aspect of the present invention, since the paper material refining apparatus includes the built-in cleaners, in case the cleaners are required, it is not necessary to connect the refining apparatus with the cleaners by a pipe, so that workability can be improved at the installation site. Also, the apparatus does not require a large space. Furthermore, since the cleaners are located at the upstream side of the screen plate, the cleaners remove the foreign substances first so as to prevent the screen plate from being damaged by the foreign substances.

According to the second aspect of the present invention, in addition to the first aspect thereof, a plurality of the cleaners is disposed in parallel such that a plurality of cleaner discharge ports for foreign substances is located near the reverse side or inside of the lid and a plurality of the cleaner outlets for the refined paper is located away from the reverse side of the lid. Therefore, the paper material refining apparatus can include the cleaners to thereby make the cleaners compact. Further, each cleaner has a small diameter, and the cleaners are disposed in parallel. Accordingly, even if the fluid pressure supplied into the cleaners is low, the cleaners can remove the foreign substances from the paper material. Furthermore, since each cleaner is made small and a plurality of cleaners is installed, the apparatus as a whole is compact and is improved in its processing ability.

According to the third aspect of the present invention, in addition to the second aspect thereof, when the lid is separated from the other part of the casing, a plurality of cleaner outlets for the refined paper material is exposed outside, so that the problems caused in the cleaner outlets, e.g. clogging, can be checked and solved easily. Also, maintenance can be easily made.

According to the forth aspect of the present invention, in addition to the first aspect thereof, the cleaners are disposed at the downstream side of the screen plate which removes the foreign substances, so that this structure can prevent the cleaners from being clogged with the foreign substances.

While the invention has been explained with reference to the specific embodiments of the invention, the explanation is illustrative and the invention is limited only by the appended claims.

What is claimed is:

1. An apparatus for refining a paper material, comprising:

a casing;

a first chamber situated in the casing and having first and second openings;

a second chamber situated inside the casing adjacent the first chamber, said second chamber having a third opening;

a screen plate situated in the casing for dividing an interior of the casing into the first and second chambers, said screen plate removing one part of foreign substances;

an agitating member situated inside the first chamber adjacent to the screen plate for agitating the paper material in the first chamber, said second opening being located near the agitating member for discharging the one part of the foreign substances; and cleaning means for removing the other part of the foreign substances contained in the paper material and situated in one of the first and second chambers, said cleaning means including a plurality of cleaners, each having at least one inlet for receiving the paper material at a peripheral portion, an outlet for discharging the paper material without containing the other part of the foreign substances and being located at one side portion, and a discharge port for discharging the other part of the foreign substances and formed at a side opposite to the outlet; a first passage communicating with the inlets of the cleaners for supplying the paper material to the cleaners; a second passage communicating with the discharge ports and having a fourth opening for discharging the other part of the foreign substances; and a third passage communicating with the outlets for providing the paper material without the other part of the foreign substances, said paper material supplied from the first opening passing through the cleaning means and the screen plate and being discharged from the third opening so that the one and the other foreign substances are substantially removed from the paper material.

2. An apparatus for refining a paper material according to claim 1, wherein said peripheral portion of the cleaner has a smooth inner surface so that the paper material entering into the cleaner turns along the smooth inner surface to form swirl to thereby remove the other part of the foreign substances by centrifugal force.

3. An apparatus for refining a paper material according to claim 2, wherein said cleaners are situated adjacent to each other so that the paper material can be substantially equally supplied to the cleaners.

4. An apparatus for refining a paper material according to claim 3, wherein each cleaner has a conical shape, said discharge port being located at a top of the conical shape, and said outlet having a cylindrical portion protruding into an inside of the cleaner.

5. An apparatus for refining a paper material according to claim 4, wherein a plurality of cleaners is disposed parallel to each other.

6. An apparatus for refining a paper material according to claim 3, wherein said cleaning means is located in the first chamber adjacent to the agitating member so that the paper material at first passes through the cleaning means and then passes through the screen plate.

7. An apparatus for refining a paper material according to claim 6, wherein said casing includes a lid and a main section, said lid being attached to and separated from the main section of the casing, said lid receiving a plurality of said cleaners and the first and second passageways, said discharge ports being located near an inner side of said lid.

8. An apparatus for refining a paper material according to claim 3, wherein said cleaning means is disposed in the second chamber, said second chamber being located adjacent to the first chamber and separated by a partition wall, said second chamber communicating with the first chamber through the screen plate so that the paper material at first passes through the screen plate and then passes through the cleaning means.

9. An apparatus for refining a paper material according to claim 8, wherein said second chamber includes a cylindrical portion separated from the first chamber through the screen plate, a main portion where the cleaning means is located, and a pipe situated between the cylindrical portion and the main portion.

10. An apparatus for refining a paper material according to claim 9, wherein said second passage is located adjacent the partition wall, said first passage extending to the screen plate, and the third passage communicating with the third opening.

11. An apparatus for refining a paper material according to claim 10, wherein said third passage communicates with the third opening.

* * * * *